US010290982B2

(12) United States Patent
Yokota et al.

(10) Patent No.: US 10,290,982 B2
(45) Date of Patent: May 14, 2019

(54) ELECTRIC CONNECTOR

(71) Applicant: FUJIKURA LTD., Kohtoh-ku, Tokyo (JP)

(72) Inventors: Koichi Yokota, Tokyo (JP); Masatoshi Maruishi, Tokyo (JP); Jinichi Mashiyama, Tokyo (JP)

(73) Assignee: FUJIKURA LTD., Kohtoh-Ku, Tokyo (JP)

( * ) Notice: Subject to any disclaimer, the term of this patent is extended or adjusted under 35 U.S.C. 154(b) by 0 days.

(21) Appl. No.: 15/968,114

(22) Filed: May 1, 2018

(65) Prior Publication Data

US 2018/0323554 A1 Nov. 8, 2018

(30) Foreign Application Priority Data

May 2, 2017 (JP) ..... 2017-091797

(51) Int. Cl.

| | |
|---|---|
| ***H01R 13/64*** | (2006.01) |
| ***H01R 13/684*** | (2011.01) |
| ***H01R 13/502*** | (2006.01) |
| ***H01R 13/639*** | (2006.01) |
| ***H01R 13/629*** | (2006.01) |
| ***H01R 13/02*** | (2006.01) |

(Continued)

(52) U.S. Cl.

CPC ..... *H01R 13/684* (2013.01); *H01R 13/02* (2013.01); *H01R 13/502* (2013.01); *H01R 13/62927* (2013.01); *H01R 13/639* (2013.01); *H01R 13/641* (2013.01); *H01R 13/71* (2013.01); *H01R 24/005* (2013.01); *H01R 13/696* (2013.01); *H01R 2201/26* (2013.01)

(58) Field of Classification Search

CPC ..... H01R 23/7005; H01R 13/64; H01R 13/62938; H01R 13/4534; H05K 1/117

USPC ..... 439/378, 680, 157, 55, 137

See application file for complete search history.

(56) References Cited

U.S. PATENT DOCUMENTS 4,915,641 A * 4/1990 Miskin ..... H01R 13/631 439/247

5,593,323 A * 1/1997 Dernehl ..... H01R 13/717 439/638

(Continued)

FOREIGN PATENT DOCUMENTS

JP 2017054612 A 3/2017

*Primary Examiner* — Phuong Chi T Nguyen

(74) *Attorney, Agent, or Firm* — Procopio, Cory, Hargreaves & Savitch LLP

(57) ABSTRACT

An electric connector includes a socket connector, a plug connector having a bar shape for connecting an electric circuit, the plug connector capable of insertion into and removed from the socket connector and to be rotatable between unlocked and locked positions about an axis thereof, a pair of detection terminals opposing across the plug connector, and a conductive member for providing electric conduction between the pair of detection terminals in the locked position of the plug connector. The conductive member includes a pair of pressed pieces arranged between the pair of detection terminals and the plug connector, spaced away from the detection terminals in the unlocked position of the plug connector, but pressed by an outer surface of the plug connector in the locked position of the plug connector to bring contact portions thereof into contact with the detection terminals and a coupling piece coupling the pair of pressed pieces.

26 Claims, 12 Drawing Sheets

(51) Int. Cl.

| | |
|---|---|
| ***H01R 13/641*** | (2006.01) |
| ***H01R 13/71*** | (2006.01) |
| ***H01R 24/00*** | (2011.01) |
| *H01R 13/696* | (2011.01) |

(56) References Cited

U.S. PATENT DOCUMENTS

| | | | | |
|---|---|---|---|---|
| 2011/0039435 | A1* | 2/2011 | Huang | H01R 27/00 439/218 |
| 2016/0149336 | A1* | 5/2016 | Smith | H01R 13/5216 439/587 |
| 2017/0070011 | A1 | 3/2017 | Ito et al. | |

* cited by examiner

ELECTRIC CONNECTOR

CROSS-REFERENCE TO RELATED APPLICATIONS

This application claims priority to Japanese Patent Application No. 2017-091797, filed May 2, 2017, the contents of which are incorporated herein by reference.

TECHNICAL FIELD

The present invention relates to an electric connector in which a plug connector is inserted to and removed from a socket connector.

BACKGROUND ART

An electrical vehicle, a hybrid vehicle or the like is provided with a maintenance electric connector (so-called a service plug). Usually, a plug connector is plugged into a receptacle connector. For maintenance of an electric system of the vehicle, the plug connector is removed from the receptacle connector, so that current from a battery can be shut off. As such an electric connector, Patent Literature 1 discloses an electric connector including a socket connector having an insertion hole and a plug connector having a bar shape, the plug connector arranged to be capable of being inserted to and removable from the insertion hole of the socket connector and to be rotatable between a unlocked position and a locked position about an axis thereof.

This electric connector further includes, as a means for detecting the locked state of the plug connector with respect to the socket connector, a conductor portion partially provided on the circumferential surface of the plug connector and a pair of detection terminals that are disposed in the insertion hole and can contact the conductive member (conductor portion) of the plug connector. When the plug connector is locked to the socket connector, the conductive member contacts the pair of detection terminals, the state being locked is detected, and current flows into a main circuit. In contrast, when the locking is released, the conductive member moves away from the pair of detection terminals, the release of locking is detected, and the current to the main circuit is shut off.

CITATION LIST

Patent Literature

[Patent Literature 1] JP 2017-054612 A

SUMMARY OF THE INVENTION

Problem to be Solved by the Invention

In the case of the electric connector described in Patent Literature 1, a clearance in the insertion and removal direction is required between an end of the plug connector and the socket connector. Therefore, when oscillations are applied to the electric connector, micro-sliding occurs between the conductive member fixed to the plug connector and the detection terminals fixed to the socket connector. When such micro-sliding occurs, plating covering the surface of the conductive member and the detection terminals is peeled off due to wear, and copper, which is the material, is exposed and oxidized. Thus, conduction between the conductive member and the detection terminals is temporarily shut off and the main circuit is shut off accordingly. There is thus a possibility that failure, so-called short interruption, occurs.

It is an object of the present invention to provide an electric connector that can overcome the aforementioned problem of the conventional technique and is capable of reducing the generation of wear at a contact zone between a conductive member and a detection terminal to maintain favorable conductivity even when oscillations are applied to the electric connector.

Means for Solving the Problem

The present invention is an electric connector with a socket connector and a plug connector having a bar shape for connecting an electric circuit, the plug connector being arranged to be capable of being inserted to and removed from the socket connector and to be rotatable between an unlocked position and a locked position about an axis thereof, the electric connector, in order to achieve the aforementioned object, including:

a pair of detection terminals opposing across the plug connector; and a conductive member for providing electric conduction between the pair of detection terminals in the locked position of the plug connector, the conductive member including:

- a pair of pressed pieces arranged between the pair of detection terminals and the plug connector, the pair of pressed pieces being spaced away from the detection terminals in the unlocked position of the plug connector, but being pressed by an outer surface of the plug connector in the locked position of the plug connector to bring contact portions thereof into contact with the detection terminals; and
- a coupling piece connecting the pair of pressed pieces.

In the case of the electric connector of the present invention, it is preferable that the plug connector include, on an outer surface thereof, proximal surfaces the distance of which from the axis is short and distal surfaces the distance of which from the axis is longer than the distance from the axis to the proximal surfaces and that the pressed pieces be pressed by the distal surfaces in the locked position of the plug connector to bring contact portions thereof into contact with the detection terminals.

In addition, in the case of the electric connector of the present invention, it is preferable that the distal surfaces be formed as curved surfaces.

Furthermore, in the case of the electric connector of the present invention, it is preferable that the pressed pieces include extended portions extending along the detection terminals between pressed portions pressed by the outer surface of the plug connector in the locked position of the plug connector and the contact portions.

Furthermore, in the case of the electric connector of the present invention, it is preferable that each of the pair of pressed pieces include the two contact portions.

Furthermore, in the case of the electric connector of the present invention, it is preferable that the socket connector include, on a side surface thereof, an opening into which the conductive member can be inserted in a direction perpendicular to the axis and that the coupling piece include a holding portion protruding in a direction of the insertion of the conductive member into the opening and held in the socket connector.

Furthermore, in the case of the electric connector of the present invention, it is preferable to include an elastic body arranged between an end of the plug connector and the socket connector and to which an end of the plug connector is pressed.

The present invention is an electric connector with a socket connector and a plug connector having a bar shape for connecting an electric circuit, the plug connector being arranged to be capable of being inserted to and removed from the socket connector and to be rotatable between an unlocked position and a locked position about an axis thereof, the electric connector, in order to achieve the aforementioned object, including:

a pair of detection terminals opposing across the plug connector;

a conductive member for providing electric conduction between the pair of detection terminals in the locked position of the plug connector; and an elastic body arranged between an end of the plug connector and the socket connector and to which an end of the plug connector is pressed.

Effect of the Invention

The electric connector of the present invention can reduce the generation of wear at a contact zone between the conductive member and the detection terminals to maintain favorable conductivity even when oscillations are applied to the electric connector.

EMBODIMENT FOR CARRYING OUT THE INVENTION

Figure 1:
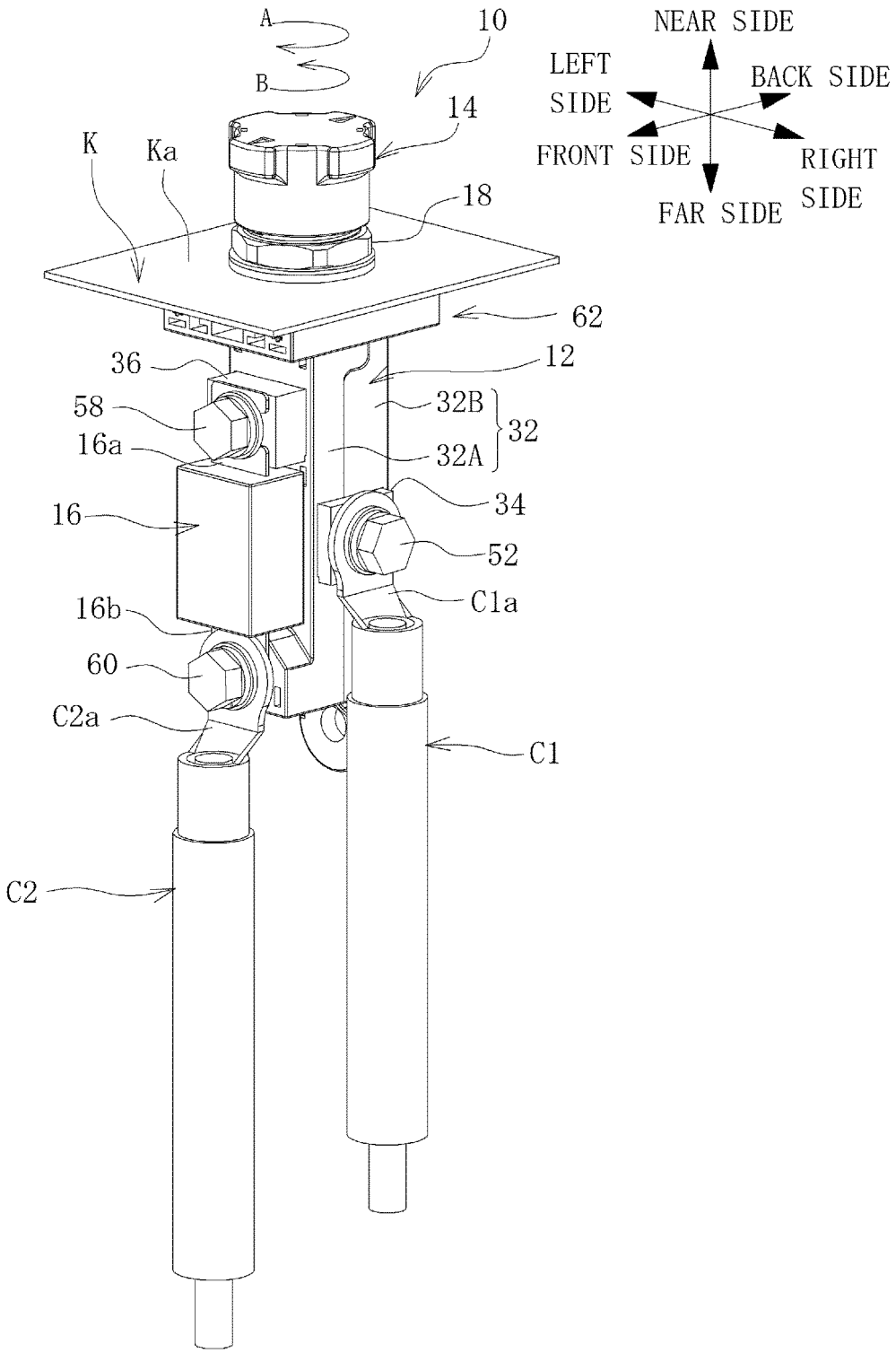
FIG. 1 is a perspective view illustrating a front side of an electric connector according to an embodiment of the present invention.
Figure 2:
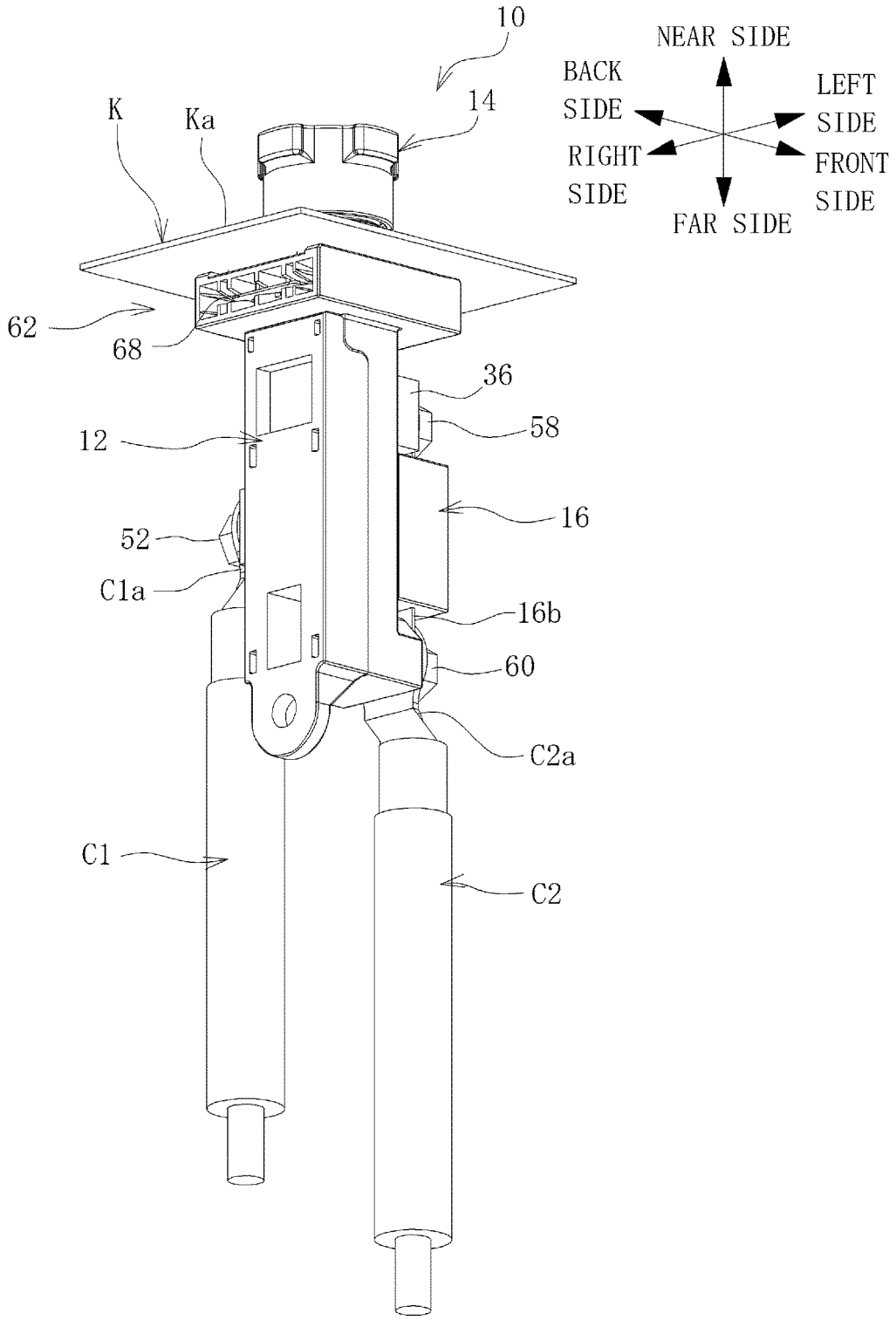
FIG. 2 is a perspective view illustrating a back side of the electric connector of FIG. 1.
Figure 3:
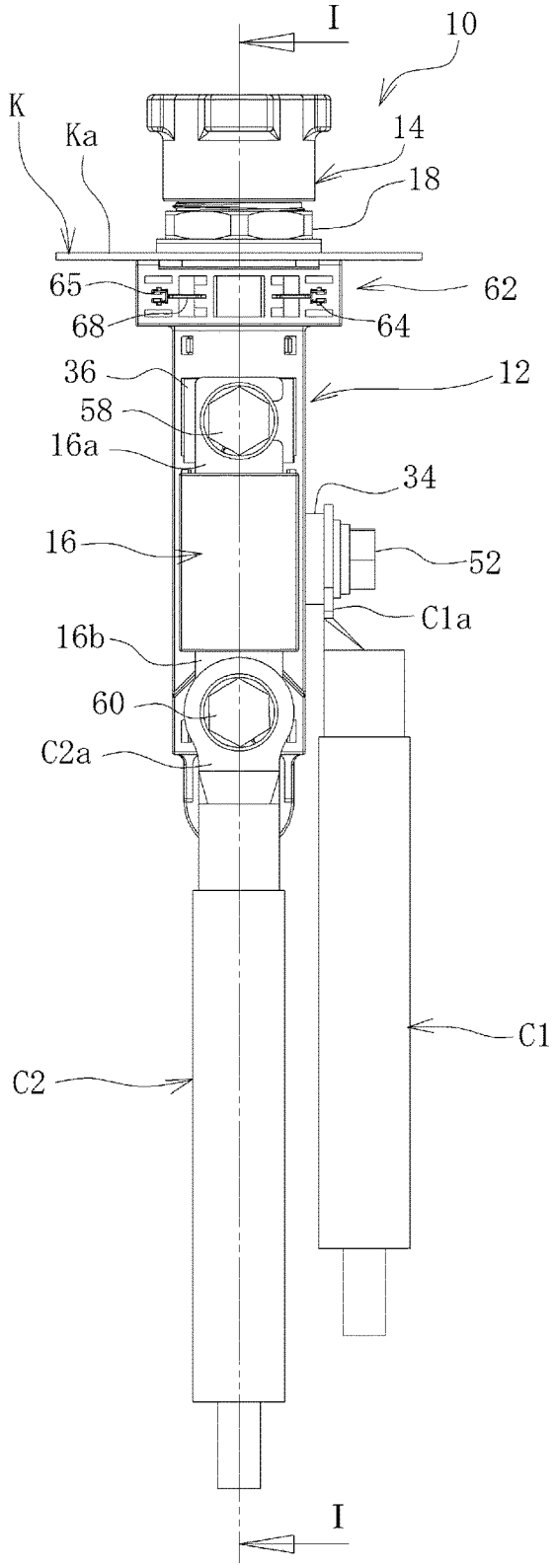
FIG. 3 is a side view of a front side of the electric connector of FIG. 1.
Figure 4:
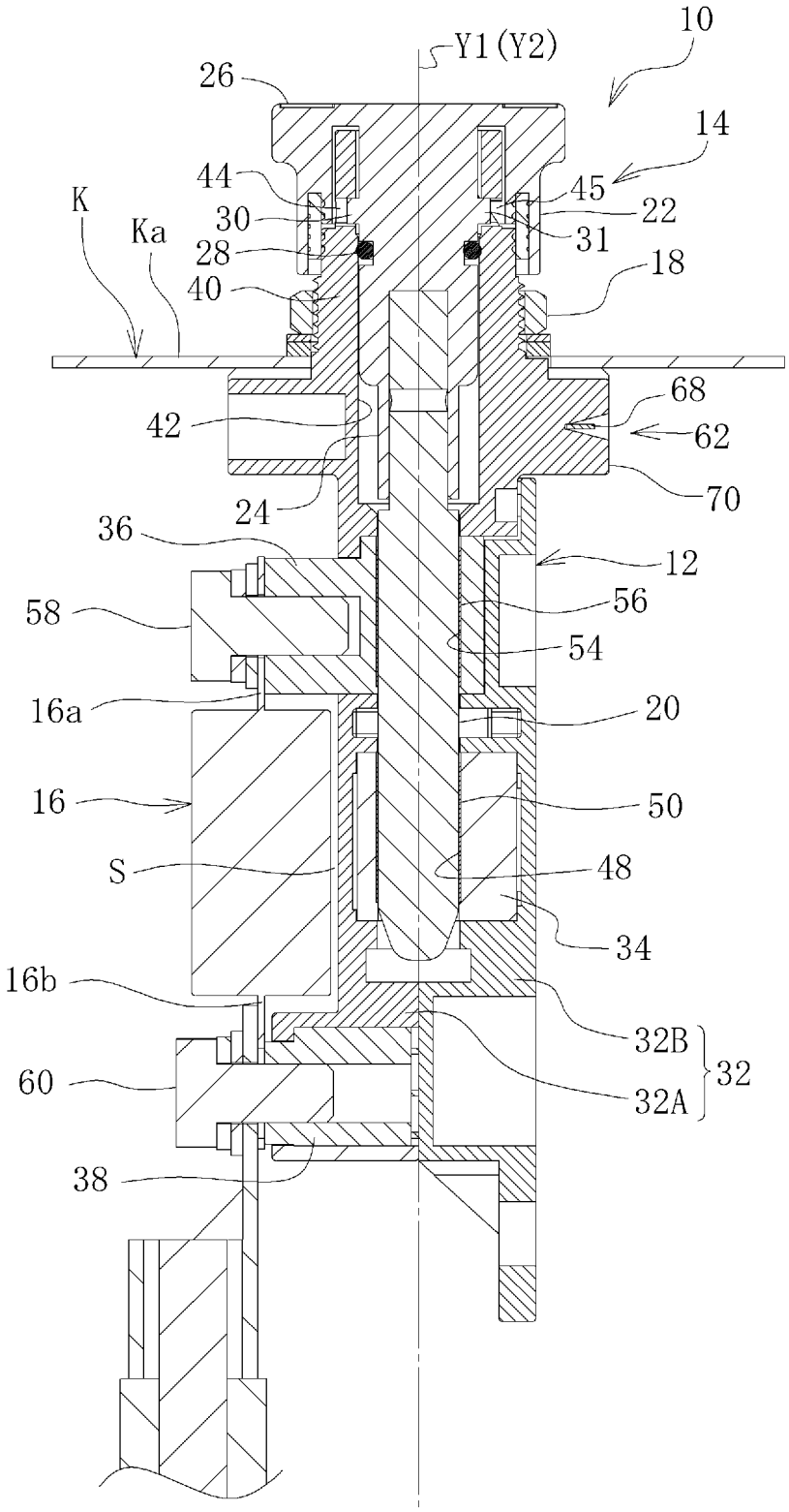
FIG. 4 is a cross-sectional view cut along line I-I of FIG. 3.

Embodiments of the present invention are described in detail below on the basis of the drawings. FIG. 1 is a perspective view illustrating a front side of an electric connector according to an embodiment of the present invention. FIG. 2 is a perspective view illustrating a back side of the electric connector of FIG. 1. FIG. 3 is a side view of a front side of the electric connector of FIG. 1. FIG. 4 is a cross-sectional view cut along line I-I of FIG. 3.

As illustrated in FIGS. 1 to 3, an electric connector 10 includes a socket connector 12 and a plug connector 14 arranged to be capable of being inserted to or removed from the socket connector 12. In addition, a fuse 16 for shutting off overcurrent is attached to the electric connector 10.

The electric connector 10 may be applied to a maintenance electric connector (so-called a service plug), e.g., of an electric vehicle or a hybrid vehicle. In this case, for maintenance of an electric system of the vehicle, the plug connector 14 is removed from the socket connector 12, so that the electric circuit can be shut off to shut off current from a battery (illustration omitted).

The electric connector 10 is accommodated in a casing K and is fixed to an upper end wall Ka of the casing K by a nut 18 or the like.

In the description below, as illustrated in FIGS. 1 and 2, the insertion direction of the plug connector 14 is defined as the "far side", the removal direction of the plug connector 14 is defined as the "near side", the left side as seen from the fuse 16 is defined as the "left side", and the right side as seen from the fuse 16 is defined as the "right side".

Figure 5:
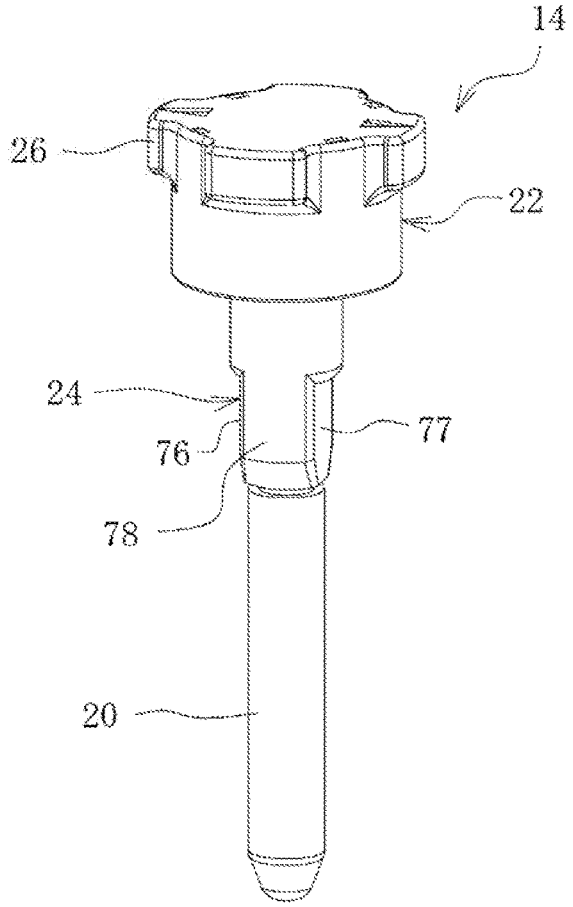
FIGS. 5(*a*) and (*b*) are perspective views illustrating a plug connector of the electric connector of FIG. 1.
Figure 5:
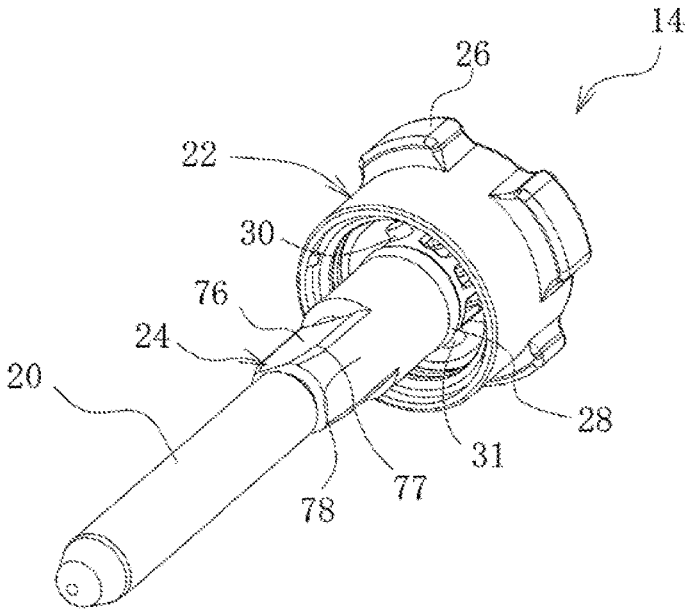

As illustrated in FIGS. 4 and 5, the plug connector 14 includes a plug contact 20 and a cap 22.

The cap 22 includes a shaft portion 24 and a pinching portion 26. The near side end of the plug contact 20 is plugged into and fixed to the shaft portion 24. The pinching portion 26 is a handle for insertion and removal of the plug connector 14.

The shaft portion 24 is provided with an O-ring 28 at an outer circumferential portion. This O-ring 28 exhibits waterproof and dustproof functions with the plug connector 14 being fit to the socket connector 12. A pair of protrusions 30, 31 protruding radially outward are formed between the O-ring 28 and the pinching portion 26 at the outer circumferential portion of the shaft portion 24. The pair of protrusions 30, 31 are displaced 180 degrees apart about an axis Y1 of the plug connector 14.

As illustrated in FIGS. 1 to 4, the socket connector 12 includes a housing 32, a first holder 34, a second holder 36, and a mounting portion 38. The first holder 34 is arranged on the far side and the second holder 36 is arranged on the near side as viewed in the insertion direction of the plug connector 14.

The housing 32 is configured as a first split body 32A is fit and connected to a second split body 32B. The housing 32 does not necessarily have to have a split structure, but may be a one-piece article.

As illustrated in FIG. 4, the near side end of the first split body 32A includes a mouth portion 40 having a roughly cylindrical shape. The mouth portion 40 is extended to the near side and is protruded from an opening of the upper end wall Ka of the casing K. The outer circumferential surface of the mouth portion 40 is externally threaded to screw into the nut 18. The first split body 32A includes an insertion hole 42, which is contiguous with the mouth portion 40 to the far side. The shaft portion 24 of the plug connector 14 can be inserted into the insertion hole 42.

In addition, the mouth portion 40 includes a pair of fitting grooves 44, 45, to which the pair of protrusions 30, 31 formed on the shaft portion 24 of the plug connector 14 can be fit. The pair of fitting grooves 44, 45 are displaced 180 degrees apart about an axis Y2 of the insertion hole 42. The fitting grooves 44, 45 include longitudinal groove portions that are opened to the tip surface of the mouth portion 40 and are extended therefrom to the far side in the direction of the axis Y2 of the insertion hole 42, and transverse groove portions that are contiguous with the longitudinal groove portions and are extended only 90 degrees about the axis Y2 of the insertion hole 42. In FIG. 4, only the transverse groove portions are visible. When the plug contact 20 and the shaft portion 24 of the plug connector 14 are inserted into the insertion hole 42, the protrusions 30, 31 are first moved to the far side along the longitudinal groove portions of the fitting groove 44, 45. When the plug connector 14 is rotated roughly 90 degrees in the direction of arrow A indicated in FIG. 1 about the axis Y2 of the insertion hole 42 with the protrusions 30, 31 being positioned at the end of the longitudinal groove portions, the protrusions 30, 31 are moved to the end of the transverse groove portions and are locked to the fitting grooves 44, 45, so that the plug connector 14 is retained and held on the socket connector 12.

As illustrated in FIGS. 1 and 3, the first holder 34 is connected to the positive electrode terminal of a battery (illustration omitted) via a primary electric cable C1 (this may be a busbar). The first holder 34 is largely arranged to be retained in the housing 32 and is partially protruded from the right side surface of the housing 32. As illustrated in FIG. 4, the part of the first holder 34 in the housing 32 includes a first insertion hole 48 into which the plug contact 20 can be inserted. A fin contact 50 having a cylindrical shape is provided between the inner circumferential surface of the first insertion hole 48 and the plug contact 20. A terminal C1*a* of the primary electric cable C1 is fixed to the part of the first holder 34 protruding from the housing 32 by a bolt 52 (see FIGS. 1 and 3).

As illustrated in FIGS. 1 and 3, the second holder 36 is connected to the negative electrode terminal of the battery via the fuse 16 and a secondary electric cable C2 (this may be a busbar). The second holder 36 is largely arranged to be retained in the housing 32 and is partially protruded from the front side surface of the housing 32. As illustrated in FIG. 4, the part of the second holder 36 in the housing 32 includes a second insertion hole 54 into which the plug contact 20 can be inserted. A fin contact 56 having a cylindrical shape is provided between the inner circumferential surface of the second insertion hole 54 and the plug contact 20. A terminal C2*a* of the secondary electric cable C2 is fixed to the part of the second holder 36 protruding from the housing 32 by a bolt 58. In addition, one terminal 16*a* of the fuse 16 is also fixed and electrically connected to the second holder 36. Therefore, when the plug contact 20 is inserted into the second insertion hole 54, the second holder 36 becomes conductive with both the one terminal 16*a* of the fuse 16 and the plug contact 20, and the one terminal 16*a* of the fuse 16 becomes electrically conductive with the plug contact 20.

As illustrated in FIG. 4, the mounting portion 38 is arranged to be retained in the housing 32, and only the front side surface thereof is exposed on the housing 32. The other terminal 16*b* of the fuse 16 and the terminal C2*a* of the secondary electric cable C2 are fixed to the mounting portion 38 by a bolt 60.

As illustrated in FIG. 3, the fuse 16 is accommodated within the width of the housing 32 in a front view. As illustrated in FIG. 4, the fuse 16 is accommodated between the top surface of the bolt 58 of the second holder 36, the top surface of the bolt 60 of the mounting portion 38, and the front side surface of the housing 32 in a side view. Between the fuse 16 and the first split body 32A and between the fuse 16 and the second holder 36, a clearance S is formed to suppress heat transfer between the fuse 16 and the housing 32 and between the fuse 16 and the second holder 36.

Figure 6:
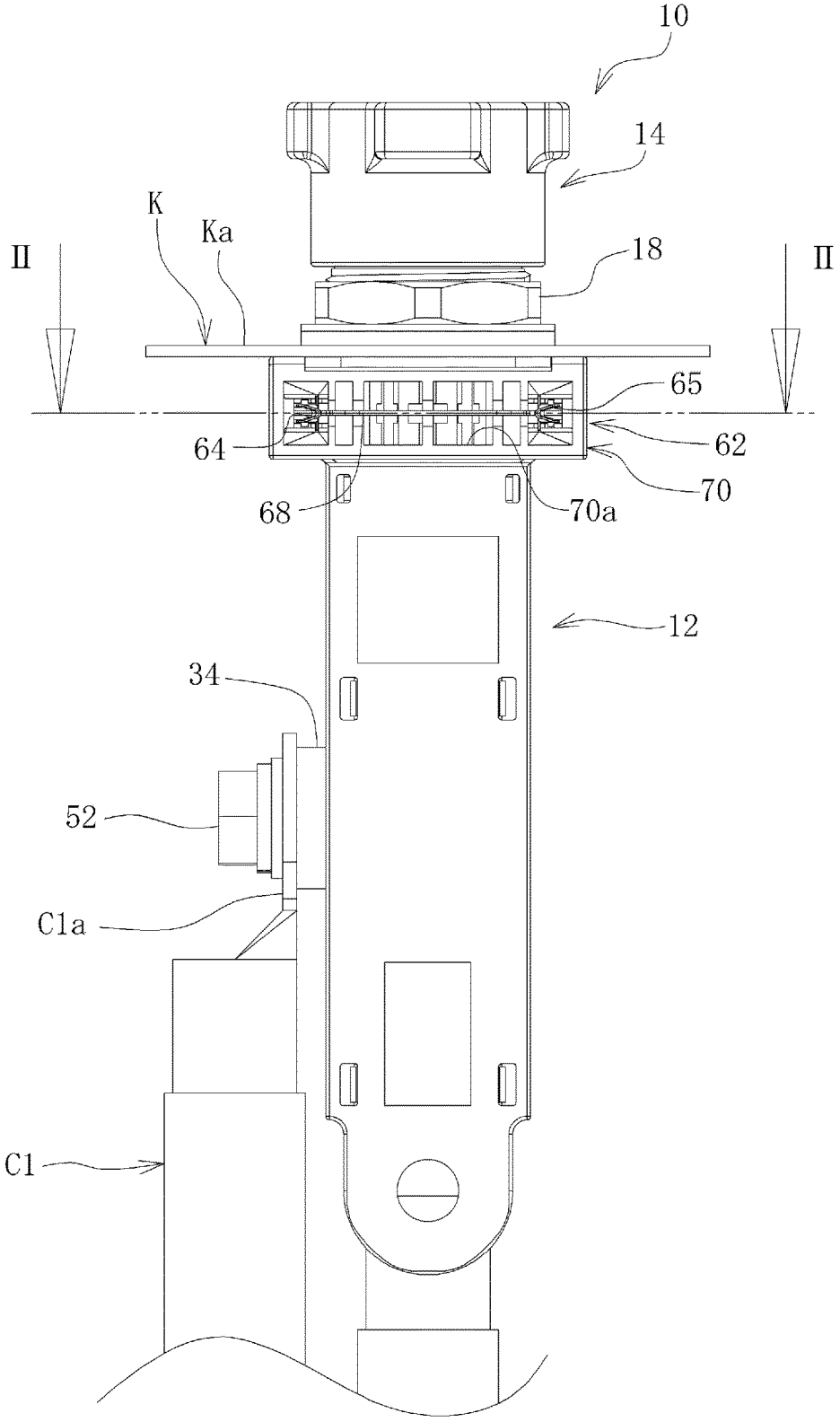
FIG. 6 is a rear view of the electric connector of FIG. 1.

In addition, as illustrated in FIG. 6, the electric connector 10 of the present embodiment includes a detection portion 62 for detecting the locked state of the plug connector 14 with respect to the socket connector 12. The detection portion 62 is arranged between the mouth portion 40 and the second holder 36 of the socket connector 12.

Figure 7:
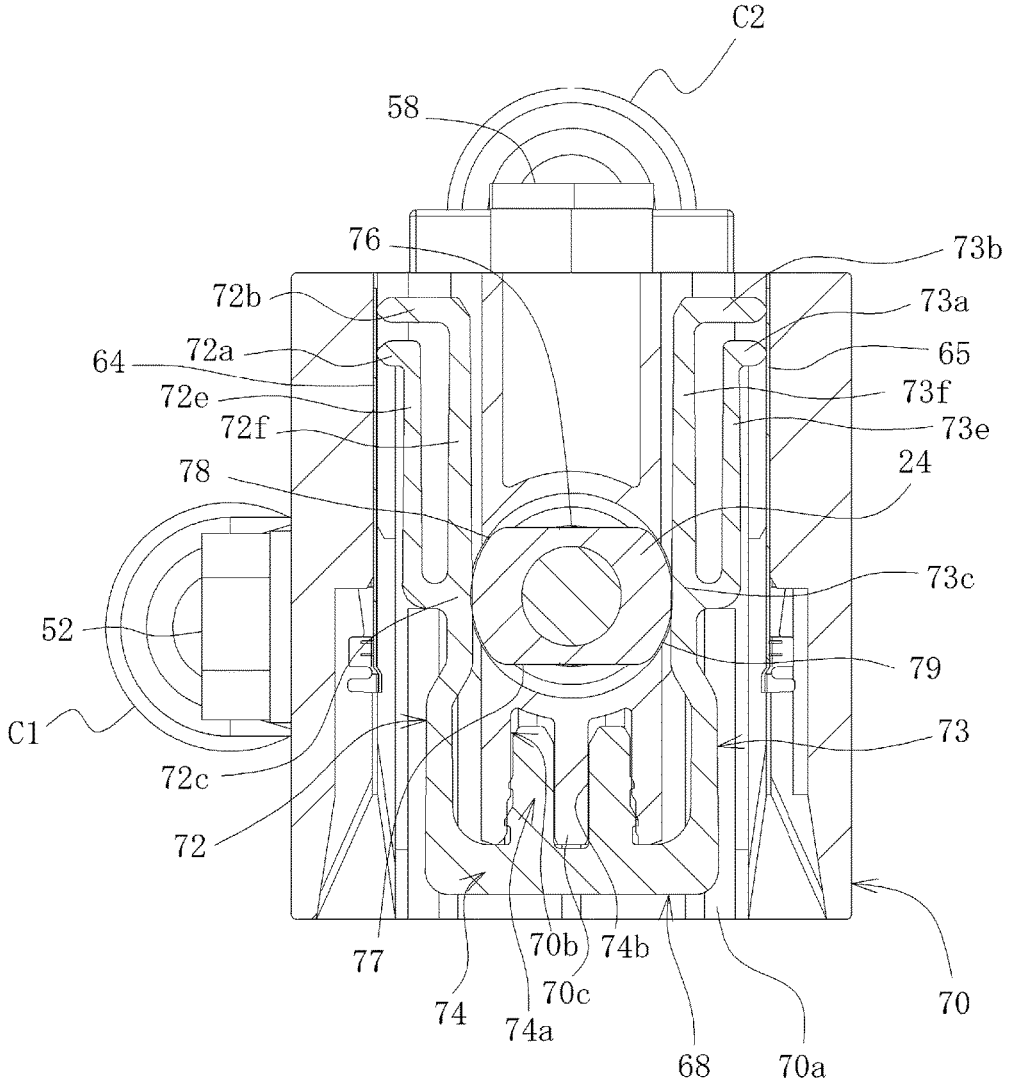
FIG. 7 is an enlarged cross-sectional view cut along line II-II of FIG. 6.
Figure 8:
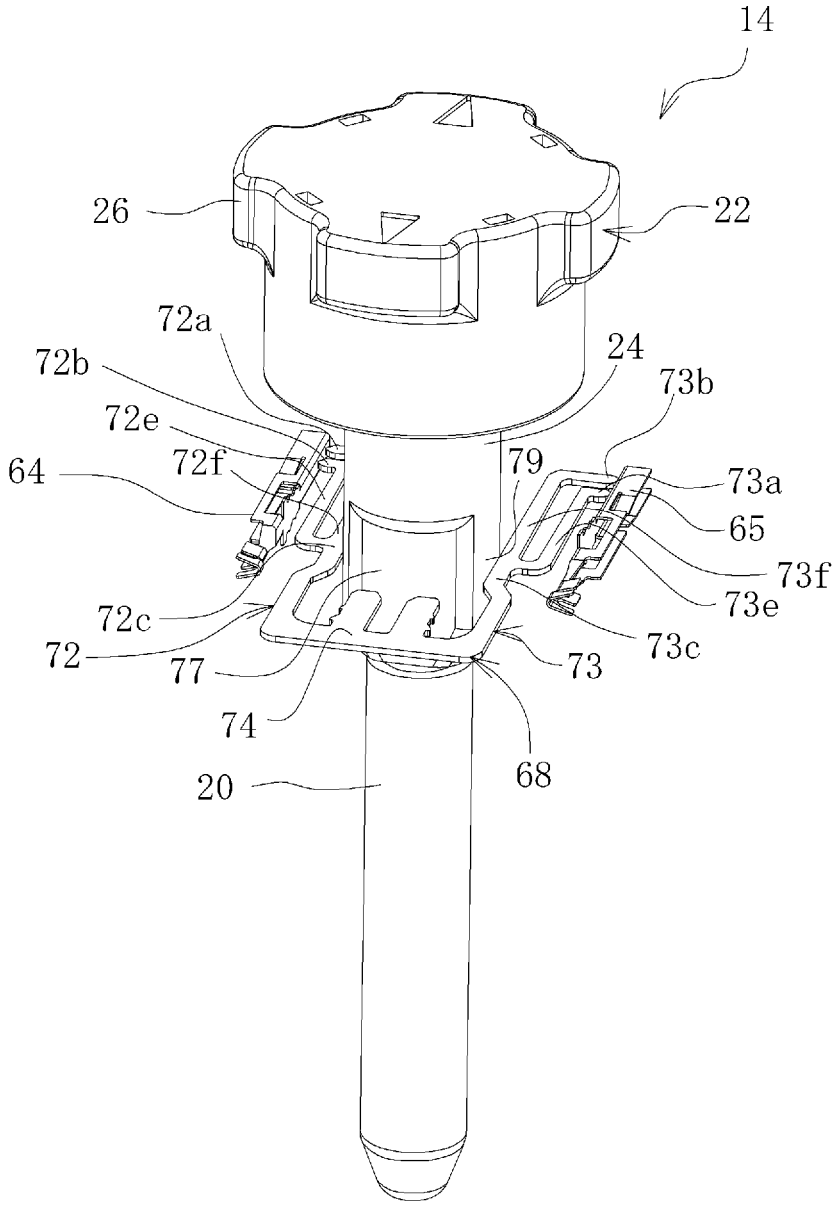
FIG. 8 is a perspective view illustrating only the plug connector, a pair of detection terminals, and a conductive member of the electric connector of FIG. 1.

As illustrated in FIGS. 7 and 8, the detection portion 62 includes a pair of detection terminals 64, 65 opposing across the shaft portion 24 of the plug connector 14, and a conductive member 68 for providing electric conduction between the pair of detection terminals 64, 65 in the locked position of the plug connector 14. The pair of detection terminals 64, 65 and the conductive member 68 are both held in a detection portion enclosure 70, which is integrally formed with the first split body 32A. Specifically, the pair of detection terminals 64, 65 and the conductive member 68 are both arranged on the socket connector 12 side.

As illustrated in FIG. 6, an opening 70*a* is formed through the back side surface of the detection portion enclosure 70. The conductive member 68 is inserted into and arranged in the detection portion enclosure 70 through the opening 70*a*.

As illustrated in FIGS. 7 and 8, the conductive member 68 includes a pair of pressed pieces 72, 73 and a coupling piece 74. The conductive member 68 is generally formed in a roughly U shape in plan view. The conductive member 68 is formed such that a metal sheet having a flat plate shape made of an electrically conductive metal material is subjected to punching and the base ends of the pair of pressed pieces 72, 73 are connected via the coupling piece 74.

The pressed pieces 72, 73 are arranged between the detection terminals 64, 65 and the shaft portion 24, respectively.

The outer surface of the shaft portion 24 of the plug connector 14 includes a pair of proximal surfaces 76, 77 the distance of which from the axis Y1 of the plug connector 14 is short, and a pair of distal surfaces 78, 79 the distance of which from the axis Y1 of the plug connector 14 is longer than the distance from the axis Y1 to the proximal surfaces 76, 77. The pair of proximal surfaces 76, 77 oppose across the axis Y1. The pair of distal surfaces 78, 79 oppose across the axis Y1. The distal surfaces 78, 79 are formed as a curved surface. The distance from the axis Y1 to the proximal surfaces 76, 77 is set to a distance over which when the proximal surfaces 76, 77 face the pressed pieces 72, 73, the proximal surfaces 76, 77 are spaced from the pressed pieces 72, 73. The distance from the axis Y1 to the distal surfaces 78, 79 is set to a distance over which when the distal surfaces 78, 79 face the pressed pieces 72, 73, the distal surfaces 78, 79 press the pressed pieces 72, 73 to bring contact portions 72*a*, 72*b*, 73*a*, 73*b* thereof into contact with the detection terminals 64, 65.

The pressed pieces 72, 73 are provided with two contact portions 72*a*, 72*b*, 73*a*, 73*b*, respectively, thereby ensuring stable conductivity between the conductive member 68 and the detection terminals 64, 65. However, the number of contact portions 72*a*, 72*b*, 73*a*, 73*b* is not limited to the above, but may be one, or three or more.

In addition, the pressed pieces 72, 73 include extended portions 72*e*, 72*f*, 73*e*, 73*f* extending in a direction away from the coupling piece 74 along the detection terminals 64, 65 between pressed portions 72*c*, 73*c* pressed by the distal surfaces 78, 79 of the plug connector 74 in the locked position of the plug connector 14 and the contact portions 72*a*, 72*b*, 73*a*, 73*b*. Thus, the pressed pieces 72, 73 can be elastically deformed more greatly to further ensure stable conductivity between the conductive member 68 and the detection terminals 64, 65. The contact portions 72*a*, 72*b*, 73*a*, 73*b* are respectively formed at the distal ends of the extended portions 72*e*, 72*f*, 73*e*, 73*f* to face the detection terminals 64, 65.

The coupling piece 74 includes a holding portion 74*a*, which is protruded in the insertion direction (front side) of the conductive member 68 and is held by, for example, pressing into a groove portion 70*b* formed in the detection portion enclosure 70. The holding portion 74*a* includes a recessed portion 74*b*, which is opened in the insertion direction and is guided by a guiding wall 70*c* formed to extend in the counter-insertion direction (back side) in the groove portion 70*b*. Thus, the conductive member 68 can be inserted straight into the detection portion enclosure 70 as the recessed portion 74*b* is guided by the guiding wall 70*c*. The number of holding portions 74*a* is not limited to one, but may be two or more. In addition, the side surface of the holding portion 74*a* may include a click for increasing the holding force to the groove portion 70*b*.

Figure 9:
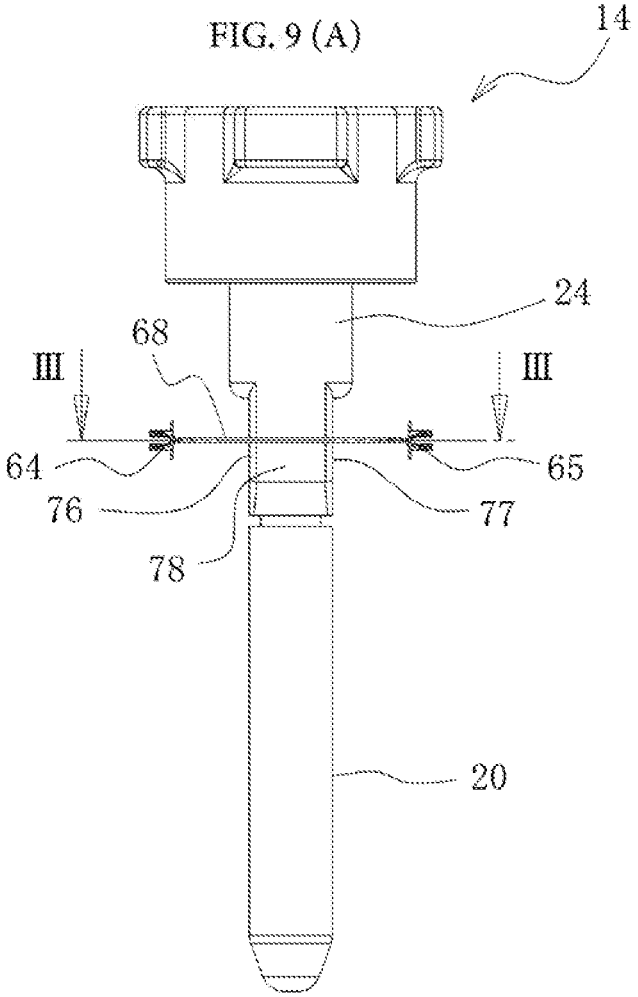
FIG. 9(*a*) is a rear view illustrating the plug connector in an unlocked state, the pair of detection terminals, and the conductive member of the electric connector of FIG. 1, and FIG. 9(*b*) is a cross-sectional view cut along line of FIG. 9(*a*).
Figure 9:
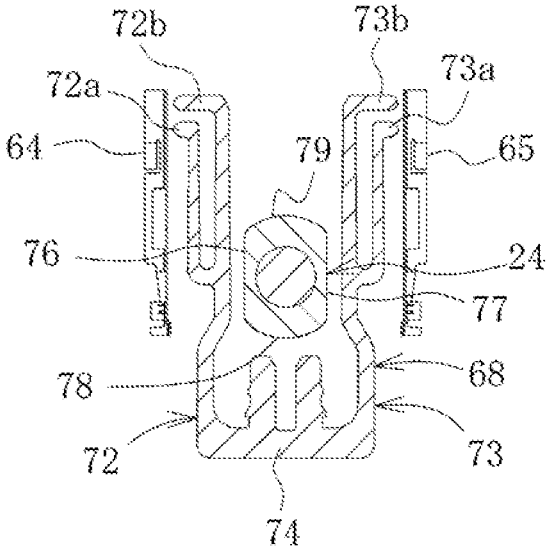

For connection of an electric circuit with the electric connector 10 configured in the aforementioned manner, the plug connector 14 is inserted into the insertion hole 42 of the socket connector 12 such that the protrusions 30, 31 formed on the inner side of the cap 22 of the plug connector 14 match the longitudinal groove portions of the fitting grooves 44, 45 formed on the mouth portion 40. In this state, as illustrated in FIG. 9, the proximal surfaces 76, 77 formed on the shaft portion 24 of the plug connector 14 face the pressed pieces 72, 73 and the proximal surfaces 76, 77 are spaced away from the pressed pieces 72, 73. Therefore, the conductive member 68 is electrically non-conductive with the pair of detection terminals 64, 65, and the unlocked state of the plug connector 14 with respect to the socket connector 12 is detected. In this case, the first holder 34 and the second holder 36 are physically conductive via the plug contact 20. However, the main circuit is configured to be electrically shut off while the detection portion 62 detects the unlocked state. Thus, the circumstance in which the plug connector 14 is inserted in a hot-line state is avoided.

Figure 10:
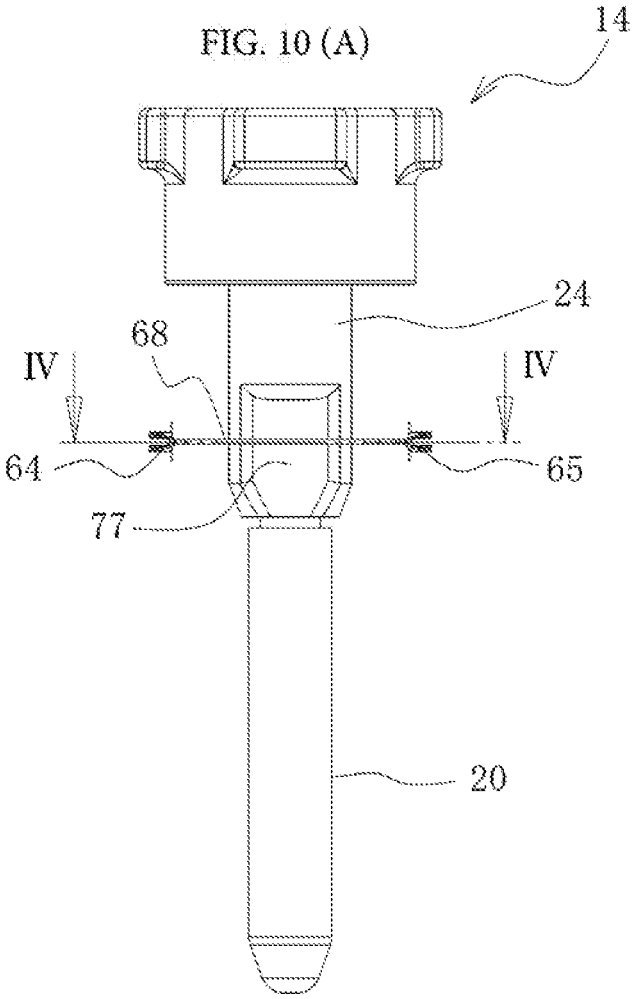
FIG. 10(*a*) is a rear view illustrating the plug connector in a locked state, the pair of detection terminals, and the conductive member of the electric connector of FIG. 1, and FIG. 10(*b*) is a cross-sectional view cut along line IV-IV of FIG. 10(*a*).
Figure 10:
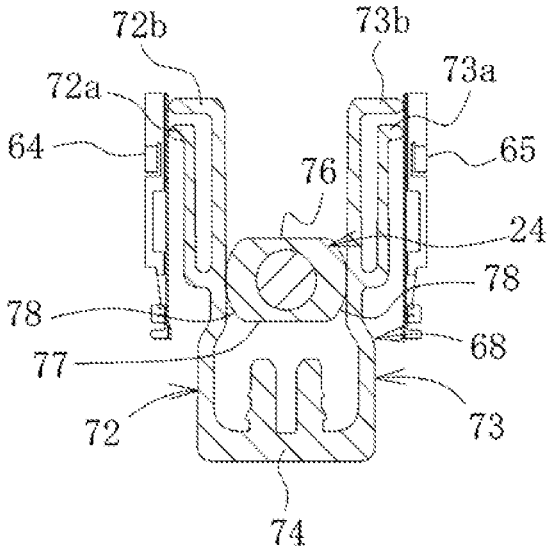

When the plug connector 14 is rotated in the above state relative to the socket connector 12 in the direction of arrow A indicated in FIG. 1, the protrusions 30, 31 are fit to the fitting grooves 44, 45, and the plug connector 14 is locked to the socket connector 12. In this state, as illustrated in FIG. 10, the distal surfaces 78, 79 of the shaft portion 24 face the pressed pieces 72, 73 to elastically deform the pressed pieces 72, 73 in a spreading manner. Thus, the contact portions 72*a*, 72*b*, 73*a*, 73*b* of the respective pressed pieces 72, 73 are brought into contact with the detection terminals 64, 65. As a result, the pair of detection terminals 64, 65 become electrically conductive via the conductive member 68, the locked state of the plug connector 14 with respect to the socket connector 12 is detected, and current flows to the main circuit.

For removal of the plug connector 14 from the socket connector 12, it is sufficient that the plug connector 14 is rotated roughly 90 degrees in the opposite direction, i.e., in the direction of arrow B indicated in FIG. 1, about the axis Y1. Thus, the protrusions 30, 31 match the longitudinal groove portions of the fitting grooves 44, 45, and the plug connector 14 can be removed. In this case, as illustrated in FIG. 9, the pressed pieces 72, 73 are released from being pressed by the distal surfaces 78, 79 and are elastically restored to the initial shape. The pair of detection terminals 64, 65 become back to non-conductive, the unlocked state of the plug connector 14 with respect to the socket connector 12 is detected, and the main circuit is electrically shut off. Therefore, the circumference in which the plug connector 14 is removed in a hot-line state is avoided. Furthermore, as the plug connector 14 is removed from the socket connector 12, the main circuit is physically shut off.

As described above, in the case of the electric connector 10 of the present embodiment, the pair of detection terminals 64, 65 and the conductive member 68 are both arranged and held on the socket connector 12 side. Therefore, even when the plug connector 14 is oscillated in the direction of the axis Y1, sliding between the detection terminals 64, 65 and the conductive member 68 is reduced. Therefore, the generation of wear due to sliding between the detection terminals 64, 65 and the conductive member 68 can be reduced, and favorable conductivity between the detection terminals 64, 65 and the conductive member 68 can be maintained.

In addition, in the case of the electric connector 10 of the present embodiment, the distal surfaces 78, 79, which press the pressed pieces 72, 73 of the conductive member 68, are formed as a curved surface to smoothly press the pressed pieces 72, 73. Thus, damage to the pressed pieces 72, 73 can be prevented.

Furthermore, in the case of the electric connector 10 of the present embodiment, the extended portions 72*e*, 72*f*, 73*e*, 73*f* provided between the pressed portions 72*c*, 73*c* and the contact portions 72*a*, 72*b*, 73*a*, 73*b* are flexibly deformed when the pressed pieces 72, 73 are pressed by the shaft portion 24. Therefore, the contact pressure of the contact portions 72*a*, 72*b*, 73*a*, 73*b* with respect to the detection terminals 64, 65 can be increased by the elastic reaction force associated with the flexible deformation.

Furthermore, in the case of the electric connector 10 of the present embodiment, the side surface of the socket connector 12 includes the opening 70*a*, into which the conductive member 68 can be inserted in a direction perpendicular to the axis Y1. Therefore, the conductive member 68 can be mounted easily.

Figure 11:
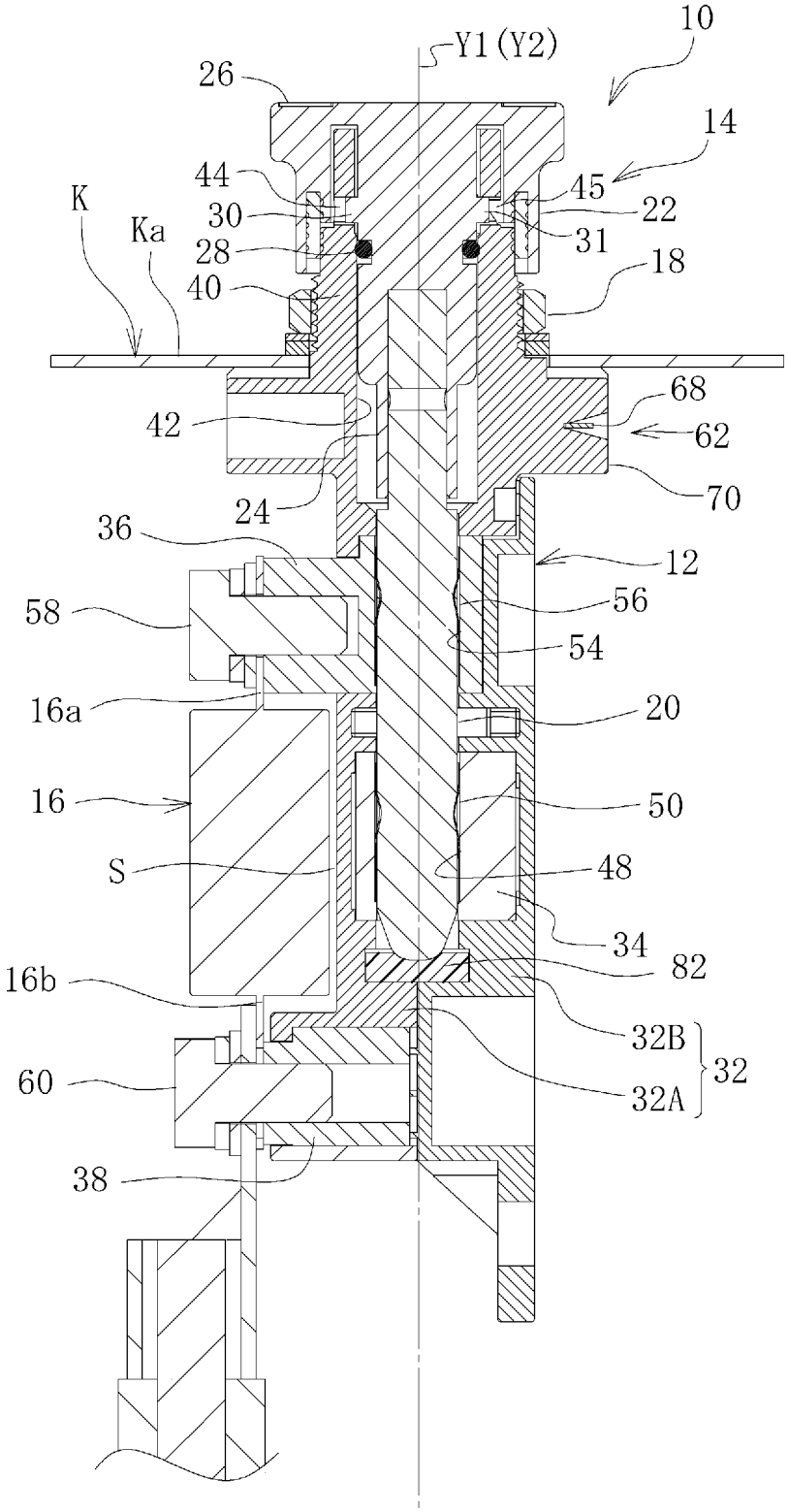
FIG. 11 is a cross-sectional view of an electric connector according to another embodiment of the present invention.

FIG. 11 is a cross-sectional view illustrating an electric connector according to another embodiment of the present invention in the same position as in FIG. 4. Members or parts similar to the members or parts described in the preceding embodiment are designated with the same reference numerals, and a description is omitted.

The electric connector 10 of the present embodiment differs from the electric connector 10 of the preceding embodiment in that an elastic body 82 having a plate shape made of rubber or elastomer is provided between an end of the plug contact 20 of the plug connector 14 and an inner wall of the housing 32 of the socket housing 32.

The end of the plug contact 20 is pressed against the elastic body 82 when the plug connector 14 is locked. The provision of the elastic body 82 enables elimination of the clearance between the end of the plug contact 20 and the housing 32 without interference with the insertion of the plug connector 14 to the final position, thereby enabling a reduction in micro-sliding of the plug connector 14. As a result, favorable conductivity between the detection terminals 64, 65 and the conductive member 68 can be maintained more reliably.

Figure 12:
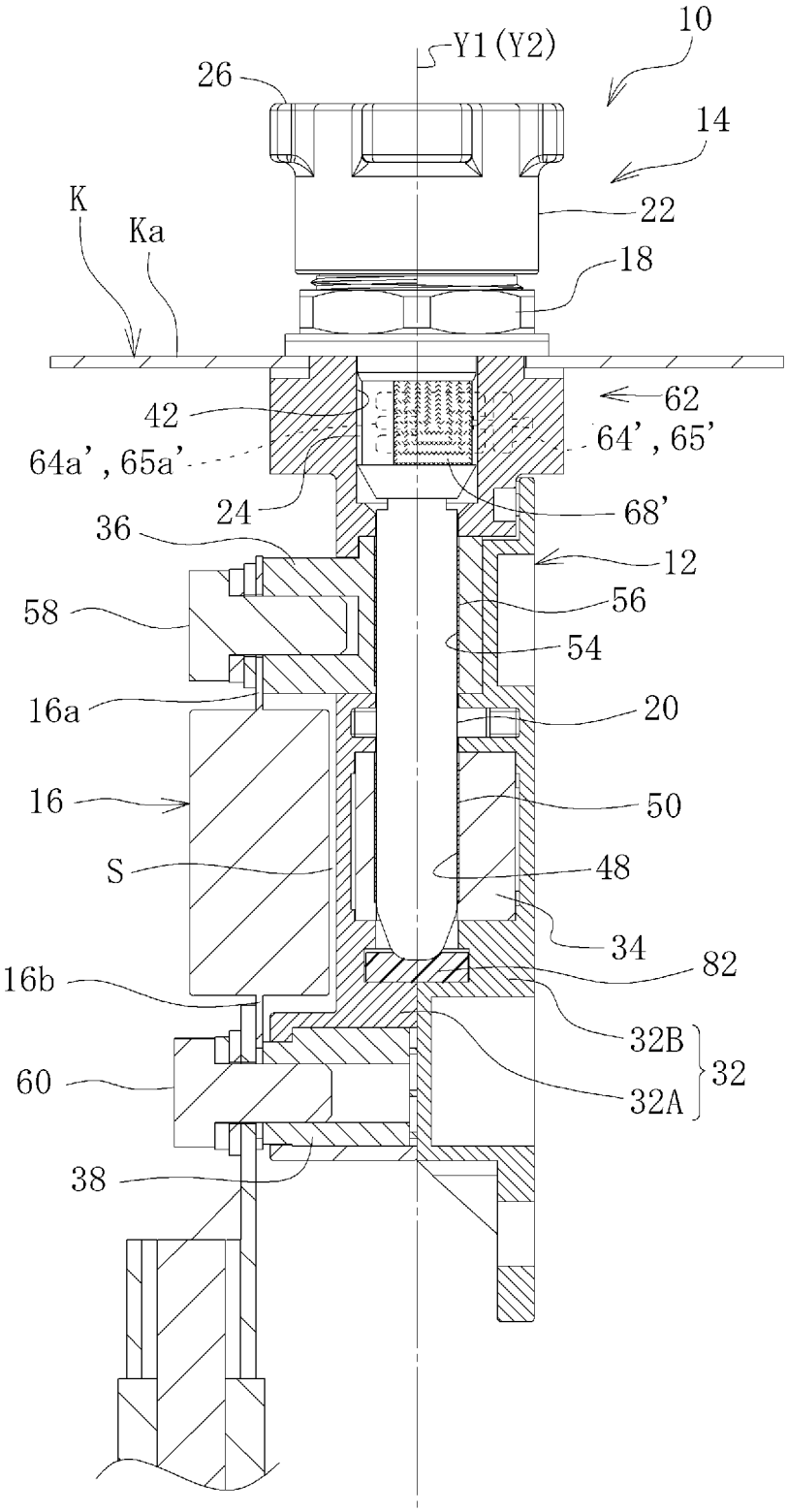
FIG. 12 is a cross-sectional view of an electric connector according to yet another embodiment of the present invention.

FIG. 12 is a cross-sectional view illustrating an electric connector according to yet another embodiment of the present invention in the same position as in FIG. 4. Members or parts similar to the members or parts described in the preceding embodiment are designated with the same reference numerals, and a description is omitted. The present embodiment differs from the preceding embodiment in terms of the shape and the arrangement of a pair of detection terminals and a conductive member.

A conductive member 68' is arranged on the plug connector 14 side. The conductive member 68' is formed over roughly half the circumference along the outer circumferential surface of the shaft portion 24.

A pair of detection terminals 64', 65' (only one of them is indicated by the dashed line in the drawing) are arranged to opposite across the shaft portion 24. In addition, the pair of detection terminals 64', 65' include elastic protrusion pieces 64*a*', 65*a*', which are protruded toward the shaft portion 24 and are in contact with the outer circumferential surface of the shaft portion 24 or the conductive member 68'. The pair of detection terminals 64', 65' are conductive via the conductive member 68' when the plug connector 14 is in the locked state, and the locked state is detected. When the plug connector 14 is in the unlocked state, at least one of the detection terminals 64', 65' contacts the outer circumferential surface of the shaft portion 24 and is not in contact with the conductive member 68'. Therefore, the pair of detection terminals 64', 65' are not conductive, and the unlocked state of the plug connector 14 with respect to the socket connector 12 is detected.

Furthermore, the electric connector 10 of the present embodiment includes the elastic body 82 having a plate shape made of rubber or elastomer between an end of the plug contact 20 of the plug connector 14 and an inner wall of the housing 32 of the socket connector 12.

The provision of the elastic body 82 enables elimination of the clearance between the end of the plug contact 20 and the housing 32 without interference with the insertion of the plug connector 14 to the final position, thereby enabling a reduction in micro-sliding of the plug connector 14. As a result, favorable conductivity between the detection terminals 64', 65' and the conductive member 68' can be maintained.

Heretofore, the present invention has been described on the basis of the illustrated examples. However, the present invention is not limited to the electric connectors of the illustrated embodiments, but may be changed within the scope of the claims. For example, in the case of the electric connectors illustrated in FIGS. 1 to 11, the conductive member includes a pair of pressed pieces and one coupling piece. However, the conductive member may have an annular shape in which a pair of pressed pieces are coupled by two coupling pieces so as to surround the circumference of the shaft portion at a distance from the shaft portion.

INDUSTRIAL APPLICABILITY

According to the present invention, an electric connector that can reduce the generation of wear at a contact zone between a conductive member and a detection terminal and maintain favorable conductivity even when oscillations are applied to the electric connector can be provided.

DESCRIPTION OF REFERENCE NUMERALS

10 electric connector
12 socket connector
14 plug connector
16 fuse
20 plug contact
22 cap
24 shaft portion
26 pinching portion
28 O-ring
30, 31 protrusion
32 housing
32A first split body
32B second split body
34 first holder
36 second holder
38 mounting portion
40 mouth portion
44, 45 fitting groove
62 detection portion
64, 65 detection terminal
68 conductive member
70 detection portion enclosure
70*a* opening
70*b* groove portion
70*c* guiding wall
72, 73 pressed piece
72*a*, 72*b*, 73*a*, 73*b* contact portion
72*c*, 73*c* pressed portion
72*e*, 72*f*, 73*e*, 73*f* extended portion
74 coupling piece
74*a* holding portion
74*b* recessed portion
76, 77 proximal surface
78, 79 distal surface
82 elastic body
Y1, Y2 axis

What is claimed is:

1. An electric connector with a socket connector and a plug connector having a bar shape for connecting an electric circuit, the plug connector being arranged to be capable of being inserted to and removed from the socket connector and to be rotatable between an unlocked position and a locked position about an axis thereof, the electric connector comprising:

a pair of detection terminals opposing across the plug connector; and a conductive member for providing electric conduction between the pair of detection terminals in the locked position of the plug connector, the conductive member including:

a pair of pressed pieces arranged between the pair of detection terminals and the plug connector, the pair of pressed pieces being spaced away from the detection terminals in the unlocked position of the plug connector, but being pressed by an outer surface of the plug connector in the locked position of the plug connector to bring contact portions thereof into contact with the detection terminals; and a coupling piece connecting the pair of pressed pieces.

2. The electric connector according to claim 1, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

3. The electric connector according to claim 1, comprising an elastic body arranged between an end of the plug connector and the socket connector and to which an end of the plug connector is pressed.

4. The electric connector according to claim 1, wherein each of the pair of pressed pieces includes the two contact portions.

5. The electric connector according to claim 4, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

6. The electric connector according to claim 1, wherein the pressed pieces include extended portions extending along the detection terminals between pressed portions pressed by an outer surface of the plug connector in the locked position of the plug connector and the contact portions.

7. The electric connector according to claim 6, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

8. The electric connector according to claim 6, wherein each of the pair of pressed pieces includes the two contact portions.

9. The electric connector according to claim 8, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

10. The electric connector according to claim 1, wherein the plug connector includes, on an outer surface thereof, proximal surfaces a distance of which from the axis is short and distal surfaces a distance of which from the axis is longer than a distance from the axis to the proximal surfaces, and the pressed pieces are pressed by the distal surfaces in the locked position of the plug connector to bring contact portions thereof into contact with the detection terminals.

11. The electric connector according to claim 10, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

12. The electric connector according to claim 10, wherein each of the pair of pressed pieces includes the two contact portions.

13. The electric connector according to claim 12, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

14. The electric connector according to claim 10, wherein the pressed pieces include extended portions extending along the detection terminals between pressed portions pressed by an outer surface of the plug connector in the locked position of the plug connector and the contact portions.

15. The electric connector according to claim 14, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

16. The electric connector according to claim 14, wherein each of the pair of pressed pieces includes the two contact portions.

17. The electric connector according to claim 16, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

18. The electric connector according to claim 10, wherein the distal surfaces are formed as a curved surface.

19. The electric connector according to claim 18, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

20. The electric connector according to claim 18, wherein each of the pair of pressed pieces includes the two contact portions.

21. The electric connector according to claim 20, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

22. The electric connector according to claim 18, wherein the pressed pieces include extended portions extending along the detection terminals between pressed portions pressed by an outer surface of the plug connector in the locked position of the plug connector and the contact portions.

23. The electric connector according to claim 22, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

24. The electric connector according to claim 22, wherein each of the pair of pressed pieces includes the two contact portions.

25. The electric connector according to claim 24, wherein the socket connector includes, on a side surface thereof, an opening into which the conductive member can be inserted in a direction perpendicular to the axis, and the coupling piece includes a holding portion protruding in a direction of insertion of the conductive member into the opening and held in the socket connector.

26. An electric connector with a socket connector and a plug connector having a bar shape for connecting an electric circuit, the plug connector being arranged to be capable of being inserted to and removed from the socket connector and to be rotatable between an unlocked position and a locked position about an axis thereof, the electric connector comprising:

a pair of detection terminals opposing across the plug connector;

a conductive member for providing electric conduction between the pair of detection terminals in the locked position of the plug connector; and an elastic body arranged between an end of the plug connector and the socket connector and to which an end of the plug connector is pressed.

* * * * *